US007572567B2

(12) United States Patent
Chung et al.

(10) Patent No.: US 7,572,567 B2
(45) Date of Patent: Aug. 11, 2009

(54) PROCESSES FOR AGGREGATING TONER COMPONENTS

(75) Inventors: Joo T. Chung, Webster, NY (US); Zhen Lai, Webster, NY (US); Joseph Leonardo, Penfield, NY (US); Derrick Black, Rochester, NY (US); Robert Heim, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 504 days.

(21) Appl. No.: 11/602,750

(22) Filed: Nov. 21, 2006

(65) Prior Publication Data

US 2008/0138739 A1 Jun. 12, 2008

(51) Int. Cl.
*G03G 9/087* (2006.01)

(52) U.S. Cl. ..... 430/137.14

(58) Field of Classification Search ..... 430/137.14
See application file for complete search history.

(56) References Cited

U.S. PATENT DOCUMENTS

| | | | | |
|---|---|---|---|---|
| 4,883,736 | A | 11/1989 | Hoffend et al. | |
| 5,264,315 | A * | 11/1993 | Tan et al. | 430/137.12 |
| 5,556,727 | A | 9/1996 | Ciccarelli et al. | |
| 5,989,453 | A * | 11/1999 | Marcq et al. | 252/301.35 |
| 2008/0138738 | A1 * | 6/2008 | Chung et al. | 430/137.14 |

OTHER PUBLICATIONS

U.S. Appl. No. 11/155,452, filed Jun. 17, 2005, Joo T. Chung, et al.

* cited by examiner

*Primary Examiner*—Hoa V Le
(74) *Attorney, Agent, or Firm*—Pillsbury Winthrop Shaw Pittman LLP

(57) ABSTRACT

Processes for preparing toner compositions used with electrostatographic imaging members. The processes utilize screw extruders to facilitate continuous dispersion and aggregation of toner components, such as color pigments and wax. The continuous dispersion produces the toner components with more control and better product yield. The products produced are also improved in quality.

22 Claims, 5 Drawing Sheets

PROCESSES FOR AGGREGATING TONER COMPONENTS

CROSS REFERENCE TO RELATED APPLICATIONS

Reference is made to, commonly assigned U.S. patent application Ser. No. 11/602,739 to Chung et al., filed Nov. 21, 2006, entitled, "Processes for toner component dispersion"

TECHNICAL FIELD

This disclosure relates to continuous processes for preparing toner compositions. More Specifically, this disclosure relates to continuous processes for emulsification and aggregation of chemical toner compositions that can be used to produce chemical toner. Currently, emulsification and aggregation processes are performed in a batch mode. Accordingly, because each individual batch process involves the handling of bulk amounts of material, each process takes many hours to complete before moving to the next process. In addition, batch-to-batch consistency is frequently difficult to achieve because of large variations of temperature, shear field, pumping capacity, and the like, throughout the stirred batch tank. However, continuous processes disclosed herein overcome all these variations because the continuous process processes a small quantity continuously under tight control. In addition, the continuous process, because it handles small quantities, reduces waste from abortion of a batch of bulk material in the case of process control malfunctions during processing. Lastly, the present disclosure relates processes for the preparation of toner that is more efficient and results in a consistent toner product.

BACKGROUND

Electrophotographic imaging members, e.g., photoreceptors, typically include a photoconductive layer formed on an electrically conductive substrate. The photoconductive layer is an insulator in the substantial absence of light so that electric charges are retained on its surface. Upon exposure to light, charge is generated by the photoactive pigment, and under applied field charge moves through the photoreceptor and the charge is dissipated.

In electrophotography, also known as xerography, electrophotographic imaging or electrostatographic imaging, the surface of an electrophotographic plate, drum, belt or the like (imaging member or photoreceptor) containing a photoconductive insulating layer on a conductive layer is first uniformly electrostatically charged. The imaging member is then exposed to a pattern of activating electromagnetic radiation, such as light. Charge generated by the photoactive pigment move under the force of the applied field. The movement of the charge through the photoreceptor selectively dissipates the charge on the illuminated areas of the photoconductive insulating layer while leaving behind an electrostatic latent image. This electrostatic latent image may then be developed to form a visible toner image by depositing oppositely charged toner particles on the surface of the photoconductive insulating layer. The resulting visible toner image may then be transferred from the imaging member directly or indirectly (such as by a transfer or other member) to a print substrate, such as transparency or paper. The imaging process may be repeated many times with reusable imaging members.

Toner utilized in development in the electrographic process is generally prepared by chemical toner processes, more specifically, mixing nanometer size emulsion polymer and latex with a color pigment and other toner components during an aggregation process, followed by a coalescence process, in which the various components are bonded together. A thermoplastic binder resin may be used in the aggregation process and may be several known polymers, such as polystyrenes, styrene-acrylic resins, styrene-methacrylic resins, styrene-butadiene resins, polyesters, epoxy resins, acrylics, urethanes and copolymers thereof. Carbon black is a common pigment used for toner compositions. Colored pigments such as red, blue, green, cyan, magenta, yellow, brown and mixtures thereof, may also be used. Other toner components my be included, for example, wax and charge enhancing additives.

As known in the art, an "emulsion" generally refers to a dispersion of one liquid in a second immiscible liquid. A "suspension" generally refers to a mixture of two substances, for example a solid and a liquid, one of which is finely divided and dispersed in the other. A "pre-suspension" is the stage of mixing the two substances before they reach a sufficient degree of dispersion in one another to be considered a suspension. "Homogenizing" is used to generally refer to the manner of breaking particles down mechanically until they are consistently dispersed or distributed throughout a liquid There are known processes and devices for preparing toner components used in toner compositions, especially color pigment dispersion and wax dispersion. For example, there are processes for pigment dispersion for preparation of toner compositions, as generally disclosed in reference U.S. Pat. No. 4,883,736, and U.S. Ser. No. 11/155,452 to Chung et al., filed Jun. 17, 2005, the disclosures of which are totally incorporated herein by reference. Examples of commercially known processes include the melt blending of the toner components in a BANBURY twin screw extruder compounder (available from Farrel Corpoation, Ansonia, Conn.), and in a dispersion of pigment and wax in aqueous phase in a batch stirred tank.

Currently, a batch process is most commonly used for the preparation of toner components such as color pigments and wax. The batch process is used to prepare the color pigment or wax dispersion in an aqueous phase, which involves a high temperature emulsification of molten wax stirred in a vessel followed by homogenization in a homogenizer, such as for example, a Gaulin homogenizer. Multiple passes through the homogenizer is required to obtain the desired level of emulsion to ensure uniformity and size. However, even though the batch process involves long processing time and consumes a great deal of energy to run the process throughout, this process does not ensure the desired level of uniformity and aggregation of the produced toner component. In fact, it is difficult to produce batch-to-batch consistency and scale-up the batches due to different batch reactions. In addition, the batch process requires constant attention as an entire batch may have to be aborted if the batch process is out of control in terms of temperature, impeller speed, and the like.

Therefore, there is a need for processes with improved dispersion of toner components used in preparing toner compositions. In addition, there is a need for processes that provide more control of the particles produced, including maintaining quality, uniformity and size, without the extensive time and energy used in more conventional methods.

The term "electrostatographic" is generally used interchangeably with the term "electrophotographic."

BRIEF SUMMARY

According to embodiments illustrated herein, there is provided processes for dispersing toner components that address the shortcomings of conventional methods discussed above.

In one embodiment, there is provided a continuous toner aggregation process, comprising continuously feeding a mixture of chemical toner components of nanometer size into a feed section of a screw extruder at a controlled rate, continuously dispersing the mixture at a controlled rate, continuously feeding an aggregation agent into the screw extruder downstream from the feed section at a controlled rate while continuously dispersing the mixture with the aggregation agent to accelerate aggregation of the mixture, aggregating the mixture, continuously emulsifying and homogenizing the aggregated mixture, and collecting the aggregated mixture from an exit section of the extruder.

In another embodiment, there is provided a process for controlling toner aggregation particle size and size distribution, comprising continuously feeding a mixture comprising a color pigment, latex, a surfactant, and de-ionized water of nanometer size into a feed section of a screw extruder at a controlled rate, continuously dispersing the mixture at a controlled rate, continuously feeding an aggregation agent into the screw extruder downstream from the feed section at a controlled rate while continuously dispersing the mixture with the aggregation agent to accelerate aggregation of the mixture, aggregating the mixture, continuously emulsifying and homogenizing the aggregated mixture, and collecting the aggregated mixture from an exit section of the extruder.

In another embodiment, there is provided a process for controlling toner aggregation particle size and size distribution, comprising continuously feeding a mixture comprising a color pigment, latex, a surfactant, and de-ionized water of nanometer size into a feed section of a screw extruder at a controlled rate, continuously dispersing the mixture at a controlled rate, continuously feeding poly-(aluminum chloride) into the screw extruder downstream from the feed section at a controlled rate while continuously dispersing the mixture with the poly-(aluminum chloride) to accelerate aggregation of the mixture, aggregating the mixture, continuously emulsifying and homogenizing the aggregated mixture, and collecting the aggregated mixture from an exit section of the extruder.

BRIEF DESCRIPTION OF THE DRAWINGS

For a better understanding of the present embodiments, reference may be had to the accompanying figures.

DETAILED DESCRIPTION

Figure 1:
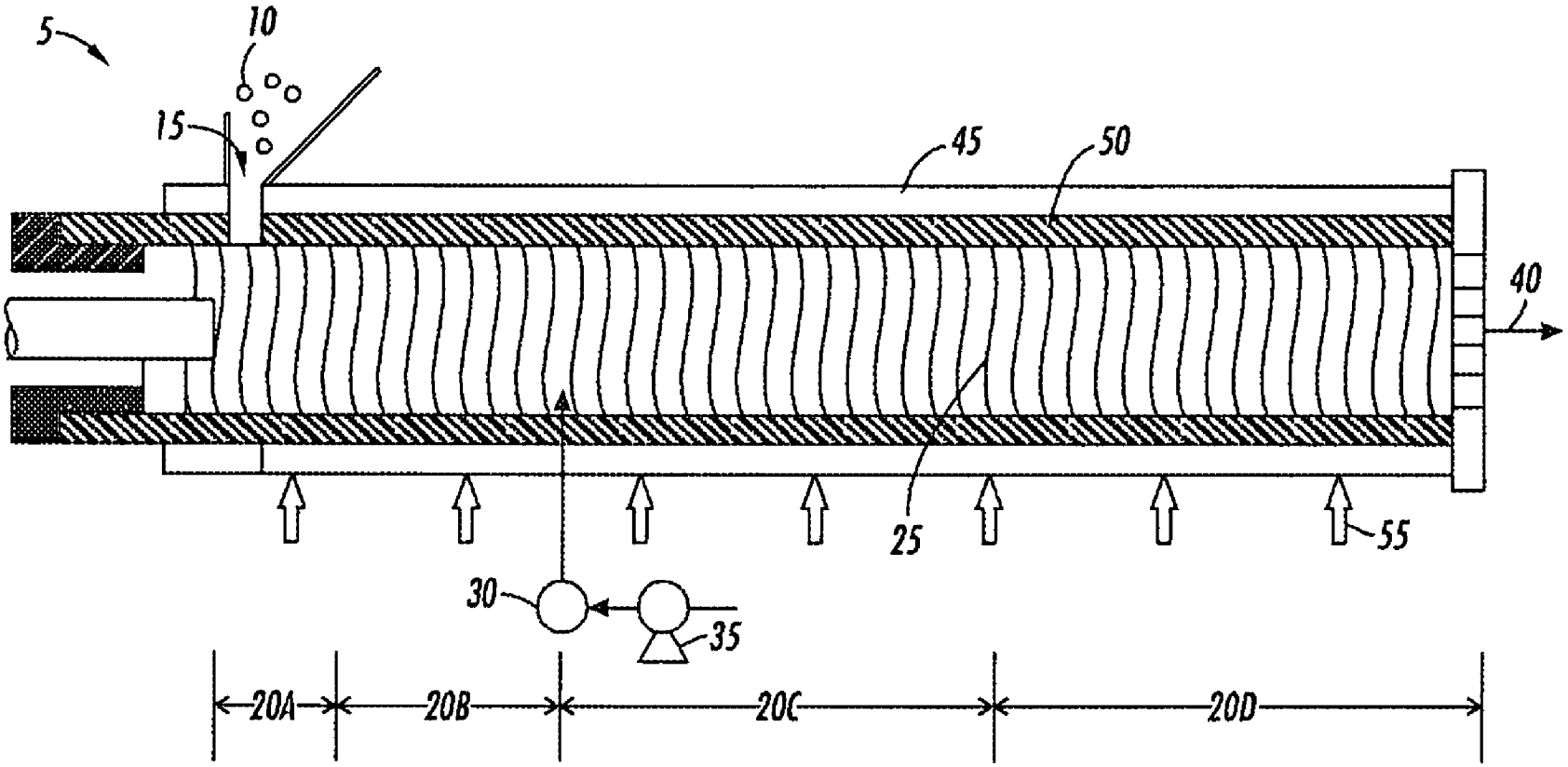
FIG. 1 is a cross-sectional view of a screw extrusion device used to perform continuous dispersion according to an embodiment of the present disclosure.

It is understood that other embodiments may be utilized and structural and operational changes may be made without departure from the scope of the embodiments disclosed herein.

The present embodiments relate to toner compositions and novel processes for preparing such toner compositions. These embodiments are based on continuous color pigment dispersion in an aqueous phase to prepare a component material that uses in chemical toners. More specifically, the present embodiments relate to processes for preparing toner pigment and wax. The processes employ a continuous dispersion using a screw extruder that provides better process control and better product yield with improved product quality.

Waxes

Waxes with, for example, a low molecular weight $M_w$ of from about 1,000 to about 10,000, such as polyethylene, polypropylene, and paraffin waxes, can be included in, or on toner compositions as, for example, fusing release agents.

Colorants

Various suitable colorants of any color can be present in the toners, including suitable colored pigments, dyes, and mixtures thereof including REGAL 330®; (Cabot), Acetylene Black, Lamp Black, Aniline Black; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like; cyan, magenta, yellow, red, green, brown, blue or mixtures thereof, such as specific phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colored pigments and dyes that can be selected are cyan, magenta, or yellow pigments or dyes, and mixtures thereof. Examples of magentas that may be selected include, for example, 2,9-dimethyl-substituted quinacridone and anthraquinone dye identified in the Color Index as Cl60710, Cl Dispersed Red 15, diazo dye identified in the Color Index as Cl26050, Cl Solvent Red 19, and the like. Other colorants are magenta colorants of (Pigment Red) PR81:2, Cl 45160:3. Illustrative examples of cyans that may be selected include copper tetra(octadecyl sulfonamido) phthalocyanine, x-copper phthalocyanine pigment listed in the Color Index as Cl74160, Cl Pigment Blue, and Anthrathrene Blue, identified in the Color Index as Cl 69810, Special Blue X-2137, and the like; while illustrative examples of yellows that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Forum Yellow SE/GLN, Cl Dispersed Yellow 33 2,5-dimethoxy-4-sulfonanilide phenylazo-4'-chloro-2,5-dimethoxy acetoacetanilides, and Permanent Yellow FGL, PY17, CI 21105, and known suitable dyes, such as red, blue, green, Pigment Blue 15:3 C.I. 74160, Pigment Red 81:3 C.I. 45160:3, and Pigment Yellow 17 C.I. 21105, and the like, reference for example U.S. Pat. No. 5,556,727, the disclosure of which is totally incorporated herein by reference.

The colorant, more specifically black, cyan, magenta and/or yellow colorant, is incorporated in an amount sufficient to impart the desired color to the toner. In general, pigment or dye is selected, for example, in an amount of from about 2 to about 10 percent by weight, or from about 2 to about 15 percent by weight for color toner, and about 3 to about 10 percent by weight for black toner.

In FIG. 1, a schematic diagram of the process for toner component dispersion is shown. The process uses a screw extruder 5, shown as a multi-screw extruder, to which the toner component 10 is fed. The toner component 10 is fed into the screw extruder 5 at a controlled rate through a hopper 15. The toner component may be a color pigment or wax. The toner component may be used in a solid phase, such as for example, a pellet or powder form.

After being fed into the screw extruder 5, the toner component 10 passes through a feed section 20A of the screw 25 and is melt and/or dispersed as it enters a second segment 20B of the screw 25. The toner component 10 is wetted and/or softened as it passes through the second segment 20B of the screw 25 of the screw extruder apparatus. A surfactant diluted in de-ionized water forms a surfactant aqueous solution 30 which is injected into the screw extruder 5 downstream from the feed section 20A. The surfactant aqueous solution 30 is injected at a controlled rate through a pressurized feed pump 35. The point of injection of the aqueous solution 30 occurs around the same point after which the toner component 10 is wetted or softened and enters a third segment 20C of the screw 25. In the third segment 20C, the toner component 10 and surfactant aqueous solution 30 are continuously mixed or dispersed as the mixture passes through. The toner component and surfactant continues down the screw 25 and enters into a fourth segment 20D of the screw 25 in which further emulsification and/or homogenization of the toner component and surfactant mixture takes place. In this fourth segment 20D, the toner component and surfactant is emulsified or suspended as the two component materials continues to mix downstream to form a toner component emulsion or suspension homogeneous. The formed toner component emulsion or suspension is then collected at the end 40 of the extruder and analyzed for uniformity and particle size.

The extruder 5 comprises a hopper 15, barrel 50, screw 25, heater 45, and temperature control thermocouples 55. The screw shaft is connected to a motor (not shown) through gear box (not shown) to turn the screw. Screw speed is accurately controlled in this manner. The barrel 50 basically provides housing of the screws, which are used for mixing, dispersing, emulsifying, and homogenizing during the process of the present embodiments under different conditions. Both the barrel 50 and screw 25 are segmented and each section can be heated at a desired temperature. The temperature is controlled by the temperature control thermocouples 55. Because the screw extruder 5 is segmented and the temperature of each section can be controlled separately, the processing temperature control is much easier and accurate, unlike large batch stirred tanks, which involve heating and controlling very large masses at the same time. The ability to set different temperature profiles along the barrel allows much better control of particle size and uniformity, which is not achieved in batch processes.

In addition, processes using the extruder 5 can be aborted if any process control malfunctioning occurs during any of the processes. Another benefit to the continuous processes is that, due to the segmentation, only a small amount of material during processing need be aborted in the case of any malfunctioning. In contrast, batch processes using batch stirred vessels must abort an entire batch.

The temperature is gradually increased as the toner component continues down the screw 25. For example, the temperature may be about 30° C. for barrel 1 through barrel 11, 70° C. for barrel 12, and 110° C. for the die. The heater 45 covers the barrel 50 of the extruder 5. Different temperatures can be set at each section of the barrel and controlled through thermocouples 55 located at each segmented barrel of the extruder 5.

In one embodiment, the toner component is toner color pigment. The color pigment is fed into the feed section 20A in a powder form and passes through the extruder 5. In the second segment 20B, the color pigment is heated and wetted and in the third segment 20C, a surfactant aqueous solution is mixed in and emulsified as the mixture passes through to form a pre-suspension. The color pigment component pre-suspension continues down the screw 25 and enters into the fourth segment 20D of the screw 25 in which further mixing and homogenization of the color pigment pre-suspension takes place. The formed color pigment suspension is then collected at the end 40 of the extruder 5 and analyzed for uniformity and particle size.

In other embodiments, the toner component is wax. The wax is fed into the feed section 20A a pellet form and passes through the extruder. The surfactant is injected or fed downstream 30 and may be heated or unheated. Heated may be, for example, at 60° C. The heated surfactant does not effect emulsification of the wax. In the second segment 20B, the wax is melted. The wax melt or mixture continues down the screw 25 and enters into a third segment 20C of the screw 25 and is emulsified with a surfactant aqueous solution. The wax and surfactant suspend and homogenize as the two component material continues to mix downstream to form a wax emulsion as it passes through the fourth segment 20D. The formed wax emulsion is then collected at the end 40 of the extruder 5 and analyzed for uniformity and particle size.

Figure 2:
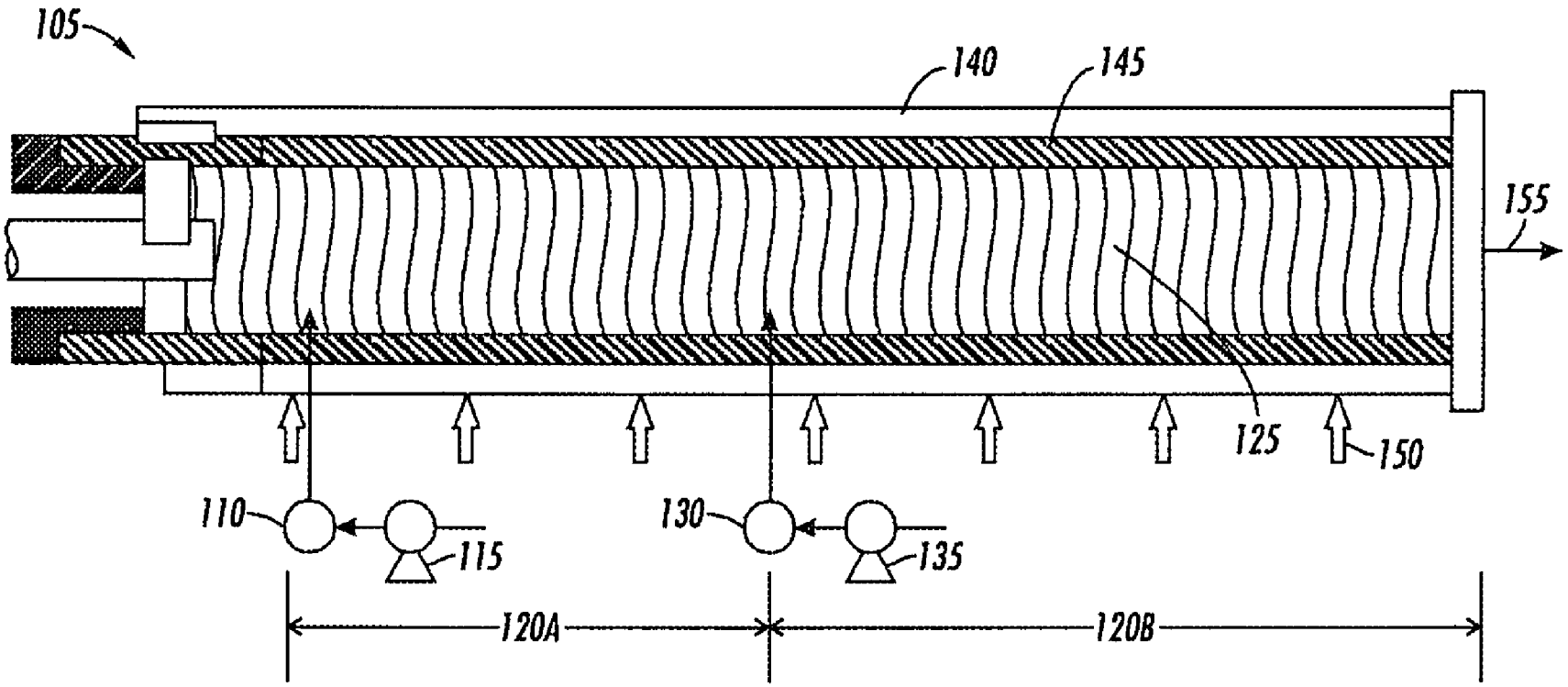
FIG. 2 is a cross-sectional view of a screw extruder apparatus used to control particle size of aggregated chemical toner during continuous chemical toner aggregation process according to another embodiment of the present disclosure

In FIG. 2, a schematic diagram of another embodiment is provided. The embodiment provides processes for continuous chemical toner aggregation. The process uses a screw extruder 105, shown as a multi-screw extruder, to which a mixture 110 of the toner component, latex, color pigment, surfactant and de-ionized water, is fed into the screw extruder 105 through a pressurized feed pump 115 at a controlled rate. The barrel 145 has a total of 13 segments and the temperature of each segment can be controlled separately. After being fed into the screw extruder 105, the toner component mixture passes through conveying and mixing section 120A of the screw extruder screw 125 where the toner component, latex, color pigment, and surfactant mixture 110 is continuously mixed. An aggregation agent solution 130 is prepared and is injected into the screw extruder 105 downstream from the pressurized feed pump 135. The aggregation agent solution 130 is injected at a controlled rate through the pressurized feed pump 135. The aggregation agent solution 130 and toner component mixture 110 is mixed, and form aggregated particles as the materials pass through mixing and homogenizing in section 120B of the screw 125. In further embodiments, the screw extruder 105 is used to perform processes for controlling toner aggregation particle size and size distribution.

In order to study the feasibility of controlling aggregated toner particle sizes with the continuous aggregation process, different experiments were carried out at three different barrel temperatures, 50° C., 55° C., and 60° C. A mixture of toner components comprising nano-sized color pigment, latex, a surfactant, and de-ionized water were continuously fed into the feed section at a controlled rate. The mixture was continuously dispersed at a controlled rate, while an aggregation agent was injected into the screw extruder downstream from the feed section at a controlled rate to aggregate the mixture. Particle growth was observed in a controlled manner. In an embodiment, the aggregation agent used is poly-(aluminum chloride) (PAC). The aggregation agent may be diluted, such as for example, being mixed with de-ionized water before injecting downstream. The aggregate agent solution may further include $HNO_3$. After the aggregate mixture is further emulsified and homogenized continuously, the aggregated mixture is collected from the extruder at the exit end 155.

No die and die plate was used to eliminate pressure in the system, which increases residence time and results in premature coalescence. The segmented heater 140 heats each of the segments in the barrel 145. Each barrel segment is heated and controlled separately at selected temperatures, as provided through thermocouples 150 located at each segment of the barrel 145. The multiple segments may be each heated to a temperature of from about 30° C. to about 110° C., or from about 50° C. to about 60° C.

The embodiments described herein were shown to provide aggregation control and uniformity in which desired particle size, particle size distribution and shape factor were obtained.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

EXAMPLES

The examples set forth herein below and are illustrative of different compositions and conditions that can be used in practicing the present embodiments. All proportions are by weight unless otherwise indicated. It will be apparent, however, that the present embodiments can be practiced with many types of compositions and can have many different uses in accordance with the disclosure above and as pointed out hereinafter.

Example 1

Wax polymer (P725) in pellet form (average diameter 518.7μ) was fed at a controlled rate of 3 lb/hr into a heated and temperature-controlled extruder at 40° C. through 110° C. Diluted surfactant in de-ionized water (2% Tayca surfactant solution) was then pumped at a location downstream of the extruder at a controlled rate of 137 g/min as soon as the wax was softened. Screw speed used in this study was 1000 rpm. Wax emulsion (15% solid concentration) was collected at the end of the extruder and particle size was measured.

Figure 3:
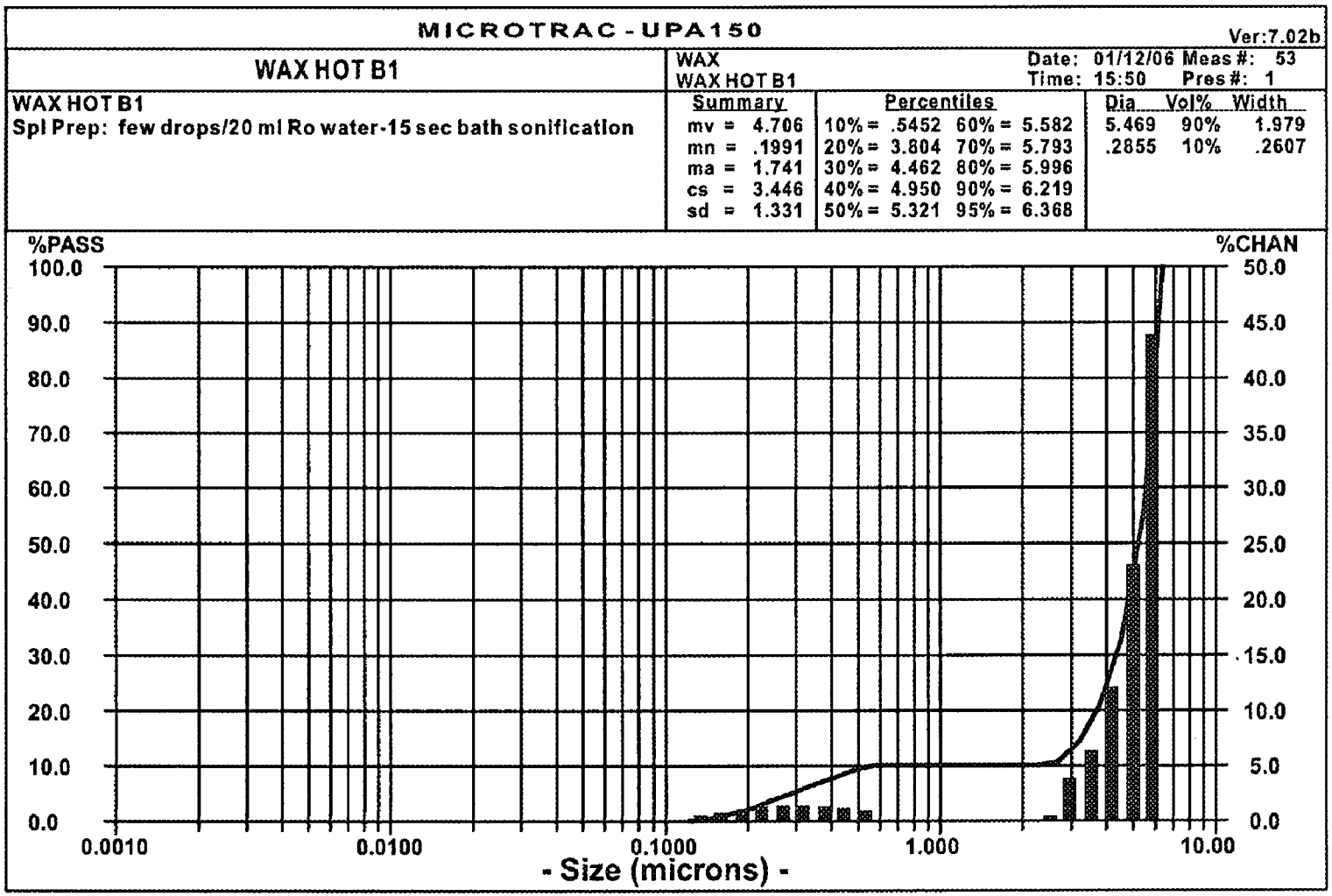
FIG. 3 is a graph of experimental data showing particle size data of a collected toner component emulsion produced by continuous wax dispersion using heated surfactant according to an embodiment of the present disclosure.

FIG. 3 shows the particle size data of a collected wax emulsion that used heated surfactant (60° C.).

Figure 4:
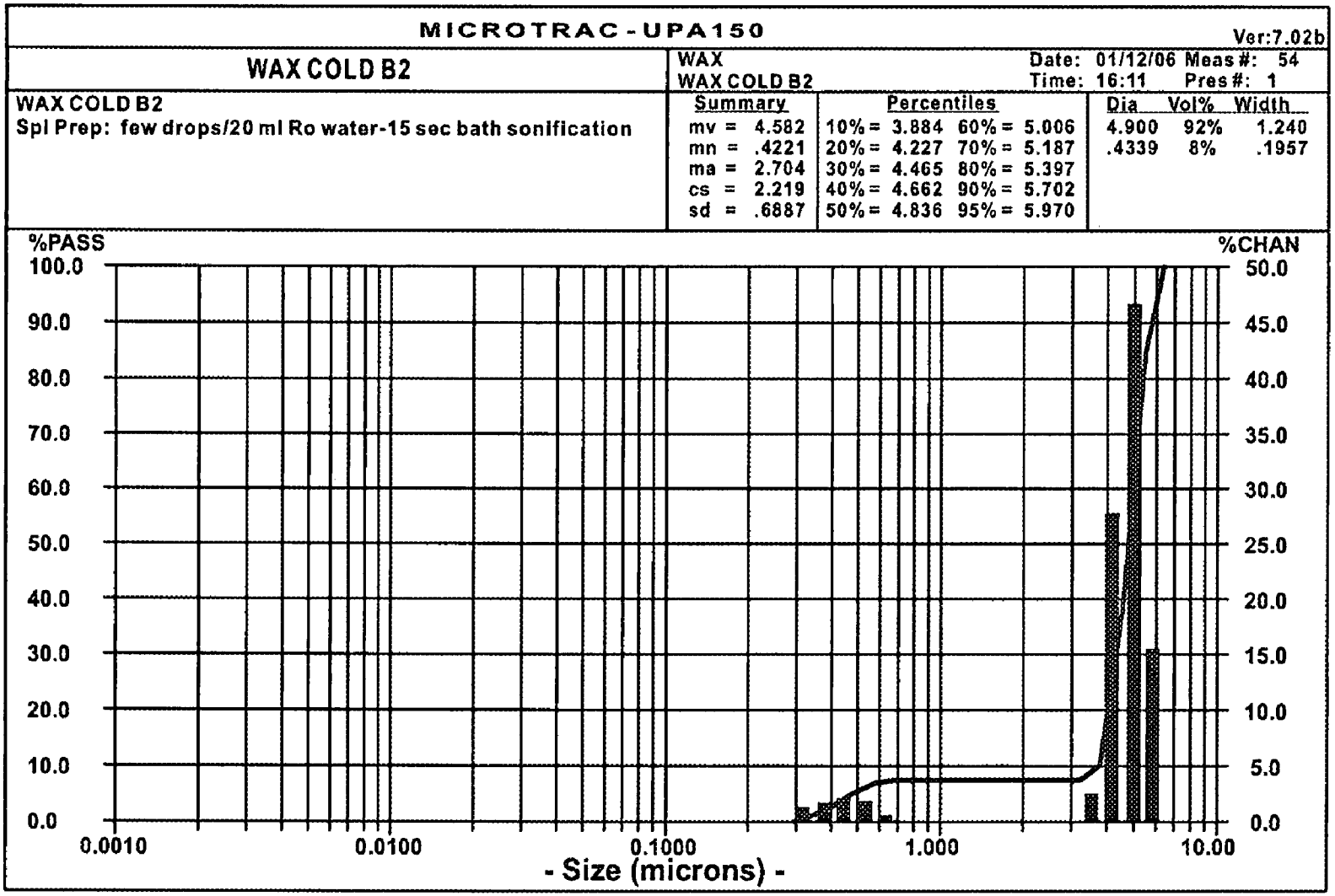
FIG. 4 is a graph of experimental data showing particle size data of a collected toner component emulsion produced by continuous wax dispersion using unheated surfactant according to another embodiment of the present disclosure.

FIG. 4 shows the particle size data of a collected wax emulsion that used unheated surfactant.

The effects on emulsification of the heated versus unheated surfactants did not exhibit any significant differences. Both cases showed bi-modal population in size, nano- and micron-size. Smaller size wax emulsion may possible to obtain varying process conditions. Primary particle size from this study was 5.5μ.

Example 2

Color pigment (Carbon Black R330) in powder form (primary particle size 200-300 nm) was fed at a controlled rate of 2 lb/hr into a heated and temperature-controlled extruder at 30° C. for barrel 1 through 11, at 70° C. for barrel 12 and at 110° C. for die. Diluted surfactant in de-ionized water (2% Tayca surfactant solution) was then pumped at the down stream of the extruder at controlled rate of 137 g/min as soon as the color pigment was softened. Screw speed used in this study was 1000 rpm. A color pigment suspension (10% solid concentration) was collected at the end of the extruder and the particle size was measured.

Figure 5:
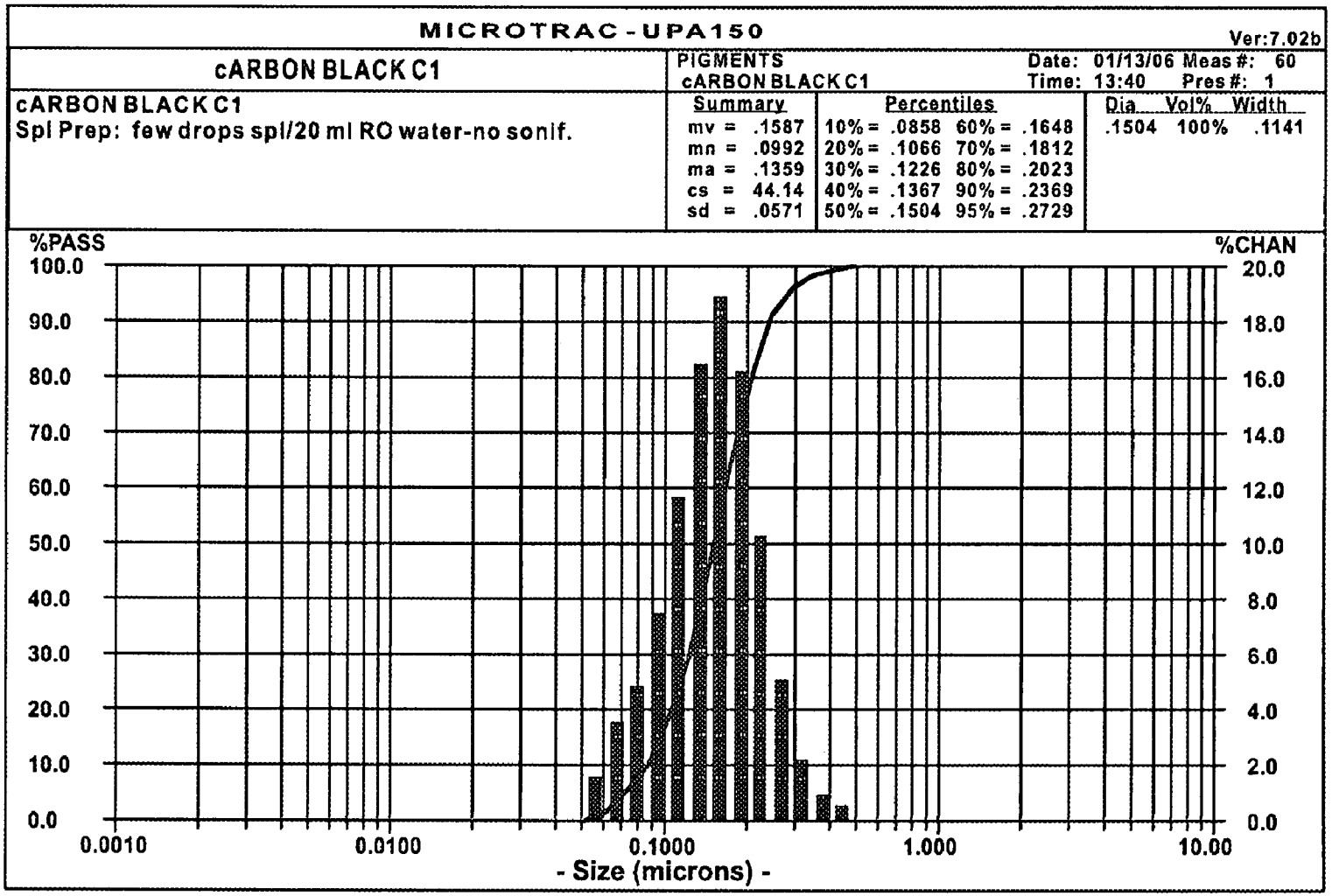
FIG. 5 is a graph of experimental data showing particle size and size distribution data for a collected toner component dispersion produced by continuous pigment dispersion according to an embodiment of the present disclosure.

FIG. 5 shows the particle size and size distribution data for the above-described pigment dispersion conducted in aqueous phase via extrusion. Primary particle size ranges 121 nm to 243 nm, which is similar to that of which vendors supply (Control).

Example 3

To test the control of uniformity and aggregation size of toner components produced by the present embodiments, the following steps were performed:

A mixture of latex, color pigment, surfactant and de-ionized water was fed into an extruder at a feed section via a pressurized feed pump at a controlled rate of 6 kg/hr. An aggregation agent "PAC" solution was prepared by mixing 30 g PAC, 0.02 mole HNO3, and 400 g de-ionized water. The aggregation agent solution was then injected at a carefully controlled rate of 0.6 kg/hr at the downstream of the extruder. The screw was specially designed with consideration of residence time, mixing capacity, stress, and shear rate in the system. This embodiment was reduced to practice at three different barrel set temperatures, 50, 55, and 60° C. separately to investigate effects of particle growth, size distribution, and shape factors at same feed rate, PAC injection rate, and same screw speed at 1000 rpm. No die and die plate used to eliminate pressure in the system, which increases residence time and results in premature coalescence. Aggregated materials collected at the end of the extruder.

The particle size, size distributions, and shape factors of the aggregated materials prepared at three separate different barrel temperatures of 50° C., 55° C., and 60° C. were measured. The particle size, size distribution and shape factors measured at the three different barrel set temperatures are shown below in Graph 1, Graph 2, and Graph 3. The particle growth was apparent at higher temperature and the size growth to be 4.31μ at 50° C., 5.49μ at 55° C., and 5.97μ at 60° C. Particle distribution also becomes narrower at higher temperatures and fines decreases. The circularity of the collected particles also exhibited a slight improvement from 0.82 to 0.89 with an increase in temperature. The shape factor at 50° C. was shown to be 0.862. The shape factor at 55° C. was shown to be 0.887. The shape factor at 60° C. was shown to be 0.886. High circularity is not expected because small nanometer size particles aggregated only during aggregation process.

| NUMBER | AVG. | S.D | Run 1 | Run 2 |
|---|---|---|---|---|
| MEDIAN: | 3.21 | .015 | 3.22 | 3.19 |
| DIAM10: | 3.31 | .007 | 3.31 | 3.30 |
16% =2.16
84% =4.43
Nmb Ratio 50/16 =1.486
Nmb Ratio 84/50 =1.381
Number % Between 1.26 um & 3.17 um =48.68
Number % Between 1.26 um & 4.00 um =74.25
| VOLUME | AVG. | S.D | Run 1 | Run 2 |
|---|---|---|---|---|
| MEDIAN: | 4.31 | .007 | 4.30 | 4.31 |
| DIAM30: | 3.67 | .001 | 3.66 | 3.67 |
| DIAM32: | 4.04 | .013 | 4.03 | 4.05 |
16% =3.20
84% =5.54
Vol Ratio 50/16 =1.348
Vol Ratio 84/50 =1.285
Volume % Between 1.26 um & 3.17 um =15.33
Volume % Between 12.70 um & 39.24 um =00.07
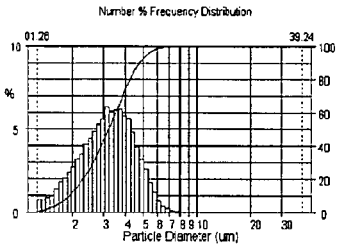
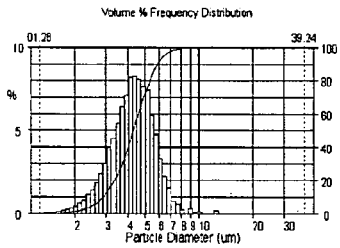
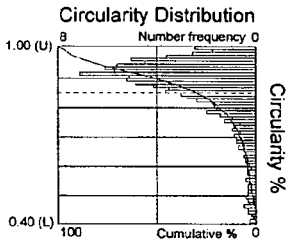
50°C
Graph 1: particle size and size distribution data for collected aggregated toner produced at 50°C.

| NUMBER | AVG. | S.D | Run 1 | Run 2 |
|---|---|---|---|---|
| MEDIAN: | 3.97 | .002 | 3.97 | 3.97 |
| DIAM10: | 4.13 | .003 | 4.13 | 4.14 |
16% =2.72
84% =5.60
Nmb Ratio 50/16 =1.456
Nmb Ratio 84/50 =1.411
Number % Between 1.26 um & 3.17 um = 27.40
Number % Between 1.26 um & 4.00 um = 50.92
| VOLUME | AVG. | S.D | Run 1 | Run 2 |
|---|---|---|---|---|
| MEDIAN: | 5.49 | .008 | 5.49 | 5.48 |
| DIAM30: | 4.60 | .004 | 4.60 | 4.60 |
| DIAM32: | 5.09 | .007 | 5.08 | 5.09 |
16% =3.98
84% =7.03
Vol Ratio 50/16 =1.378
Vol Ratio 84/50 =1.282
Volume % Between 1.26 um & 3.17 um = 05.01
Volume % Between 12.70 um & 39.24 um = 00.00
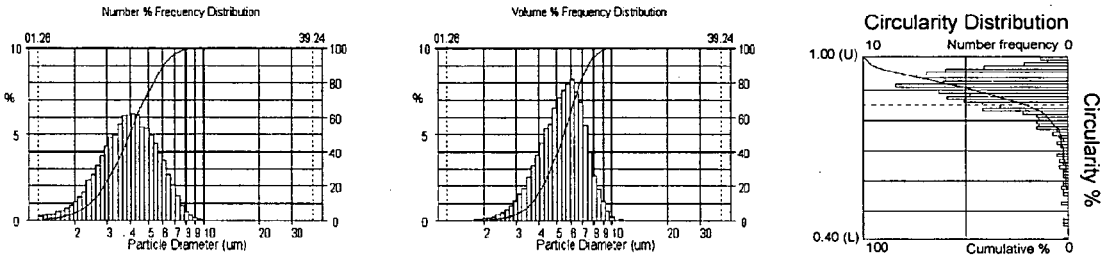
55°C
Graph 2: particle size and size distribution data for collected aggregated toner produced at 55°C.

| NUMBER | AVG. | S.D | Run 1 | Run 2 |
|---|---|---|---|---|
| MEDIAN: | 4.65 | .018 | 4.64 | 4.66 |
| DIAM10: | 4.75 | .027 | 4.73 | 4.77 |
16% =3.28
84% =6.23
Nmb Ratio 50/16 =1.416
Nmb Ratio 84/50 =1.339
Number % Between 1.26 um & 3.17 um =13.81
Number % Between 1.26 um & 4.00 um =32.53
| VOLUME | AVG. | S.D | Run 1 | Run 2 |
|---|---|---|---|---|
| MEDIAN: | 5.97 | .059 | 5.93 | 6.02 |
| DIAM30: | 5.20 | .028 | 5.18 | 5.22 |
| DIAM32: | 5.67 | .025 | 5.66 | 5.69 |
16% =4.52
84% =7.60
Vol Ratio 50/16 =1.321
Vol Ratio 84/50 =1.271
Volume % Between 1.26 um & 3.17 um =01.83
Volume % Between 12.70 um & 39.24 um =01.08
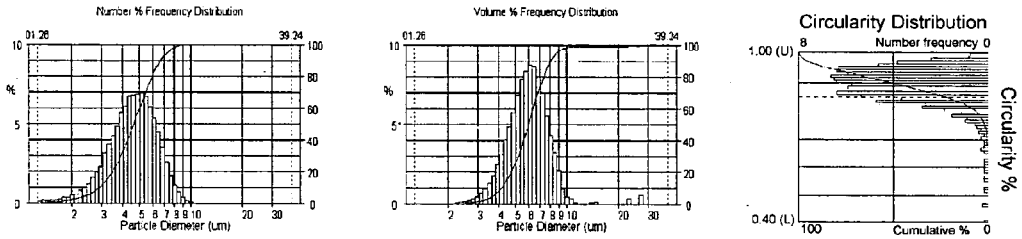
60°C
Graph 3: particle size and size distribution data for collected aggregated toner produced at 60°C.

All the patents and applications referred to herein are hereby specifically, and totally incorporated herein by reference in their entirety in the instant specification.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A continuous toner aggregation process, comprising:

continuously feeding a mixture of chemical toner components of nanometer size into a feed section of a screw extruder at a controlled rate;

continuously dispersing the mixture at a controlled rate;

continuously feeding an aggregation agent into the screw extruder downstream from the feed section at a controlled rate while continuously dispersing the mixture with the aggregation agent to accelerate aggregation of the mixture;

aggregating the mixture;

continuously emulsifying and homogenizing the aggregated mixture; and collecting the aggregated mixture from an exit section of the extruder.

2. The process of claim 1, wherein the chemical toner components comprise a color pigment, latex, a surfactant, and de-ionized water.

3. The process of claim 1, wherein the aggregation agent is diluted.

4. The process of claim 1, wherein the collected aggregated mixture has aggregated particles of micrometer size.

5. The process of claim 1, wherein an aggregate agent is mixed with de-ionized water before being continuously fed into the screw extruder.

6. The process of claim 1, wherein the aggregate agent is poly-(aluminum chloride).

7. The process of claim 6, wherein the aggregate agent solution further includes $HNO_3$.

8. The process of claim 1, wherein the screw extruder includes multiple segments and each segment is heated to a temperature of from about 30° C. to about 110° C.

9. The process of claim 8, wherein the screw extruder includes multiple segments and each segment is heated to a temperature of from about 50° C. to about 60° C.

10. The process of claim 1, wherein particle size and size distribution of the collected aggregated mixture is controlled.

11. The process of claim 1, wherein particle size and size distribution of the collected aggregated mixture is uniform.

12. A process for controlling toner aggregation particle size and size distribution, comprising:

continuously feeding a mixture comprising a color pigment, latex, a surfactant, and de-ionized water of nanometer size into a feed section of a screw extruder at a controlled rate;

continuously dispersing the mixture at a controlled rate;

continuously feeding an aggregation agent into the screw extruder downstream from the feed section at a controlled rate while continuously dispersing the mixture with the aggregation agent to accelerate aggregation of the mixture;

aggregating the mixture;

continuously emulsifying and homogenizing the aggregated mixture; and collecting the aggregated mixture from an exit section of the extruder.

13. The process of claim 12, wherein the collected aggregated mixture has aggregated particles of micrometer size.

14. The process of claim 12, wherein an aggregate agent is mixed with de-ionized water before being continuously fed into the screw extruder.

15. The process of claim 12, wherein the aggregate agent is poly-(aluminum chloride).

16. The process of claim 12, wherein the screw extruder includes multiple segments and each segment is heated to a temperature of from about 30° C. to about 110° C.

17. The process of claim 12, wherein particle size and size distribution of the collected aggregated mixture is uniform.

18. A process for controlling toner aggregation particle size and size distribution, comprising:

continuously feeding a mixture comprising a color pigment, latex, a surfactant, and de-ionized water of nanometer size into a feed section of a screw extruder at a controlled rate;

continuously dispersing the mixture at a controlled rate;

continuously feeding poly-(aluminum chloride) into the screw extruder downstream from the feed section at a controlled rate while continuously dispersing the mixture with the poly-(aluminum chloride) to accelerate aggregation of the mixture;

aggregating the mixture;

continuously emulsifying and homogenizing the aggregated mixture; and collecting the aggregated mixture from an exit section of the extruder.

19. The process of claim 18, wherein the collected aggregated mixture has aggregated particles of micrometer size.

20. The process of claim 18, wherein the poly-(aluminum chloride) is mixed with de-ionized water before being continuously fed into the screw extruder.

21. The process of claim 18, wherein the screw extruder includes multiple segments and each segment is heated to a temperature of from about 30° C. to about 110° C.

22. The process of claim 18, wherein particle size and size distribution of the collected aggregated mixture is uniform.

* * * * *